United States Patent [19]

Rees et al.

[11] 4,004,645

[45] Jan. 25, 1977

[54] DISC CUTTING UNITS FOR USE ON ROCK BORING MACHINES

[76] Inventors: Gwilym James Rees, 11 Granada Road; Henry Bingham, 26 Coaton Ave., both of Selcourt, Springs, Transvaal, South Africa

[22] Filed: July 22, 1975

[21] Appl. No.: 598,167

[30] Foreign Application Priority Data

July 31, 1974 South Africa ..... 74/4897

[52] U.S. Cl. ..... 175/373; 175/410

[51] Int. Cl.[2] ..... E21B 9/08

[58] Field of Search ..... 299/93; 175/351, 352, 175/373, 374, 375, 410, 413; 30/347; 51/170 T, 176

[56] References Cited

UNITED STATES PATENTS

| | | | |
|---|---|---|---|
| 1,143,275 | 6/1915 | Hughes | 175/373 X |
| 1,691,623 | 11/1928 | Black | 175/375 |
| 3,041,055 | 6/1962 | Risse | 175/373 X |
| 3,596,724 | 8/1971 | Bechem | 175/375 |
| 3,791,465 | 2/1974 | Metge | 175/373 |

*Primary Examiner*—Ernest R. Purser
*Assistant Examiner*—Richard E. Favreau
*Attorney, Agent, or Firm*—Cushman, Darby & Cushman

[57] ABSTRACT

A rock boring machine of the kind consisting of a rotatable headplate on the front face of which is mounted a plurality of rotatable disc cutters, each disc cutter comprising an annular body, a plurality of cutting segments located on and substantially encircling the annular body around the periphery thereof, and removable clamping means for securing the cutting segments to the annular body. Each cutting segment is provided with a suitable formation adapted to engage with a complemental formation on the annular body to prevent peripheral movement of the segments around the annular body.

4 Claims, 4 Drawing Figures

DISC CUTTING UNITS FOR USE ON ROCK BORING MACHINES

This invention relates broadly to rock boring machines of the kind consisting of a rotatable headplate on the front face of which is mounted a plurality of rotatable disc cutters. Such machines are primarily used for cutting through rock formations.

More particularly the invention relates to rock boring machines in which each disc cutter comprises an annular body, a plurality of cutting segments located on and substantially encircling the annular body around the periphery thereof, and removable clamping means for securing the cutting segments to the annular body.

One of the problems which has been encountered in such disc cutters is that the cutting segments tend to move peripherally relative to the annular body thus impairing the cutting efficiency of the machine.

It is an object of the present invention to provide a rock boring machine of the type described above in which the above-mentioned problem is eliminated.

According to the invention each cutting segment is provided with a formation adapted to engage with a complemental formation on the annular body in order to prevent peripheral movement of the segments around the annular body.

Further according to the invention the formation on each cutting segment comprises a key which is adapted to engage with a complemental slot in the annular body.

Further according to the invention the key on each cutting segment is formed integrally with a base portion which, in turn, is suitably secured to the cutting segment.

To illustrate the invention an embodiment thereof is described hereunder with reference to the accompanying drawings in which.

Figure 4:
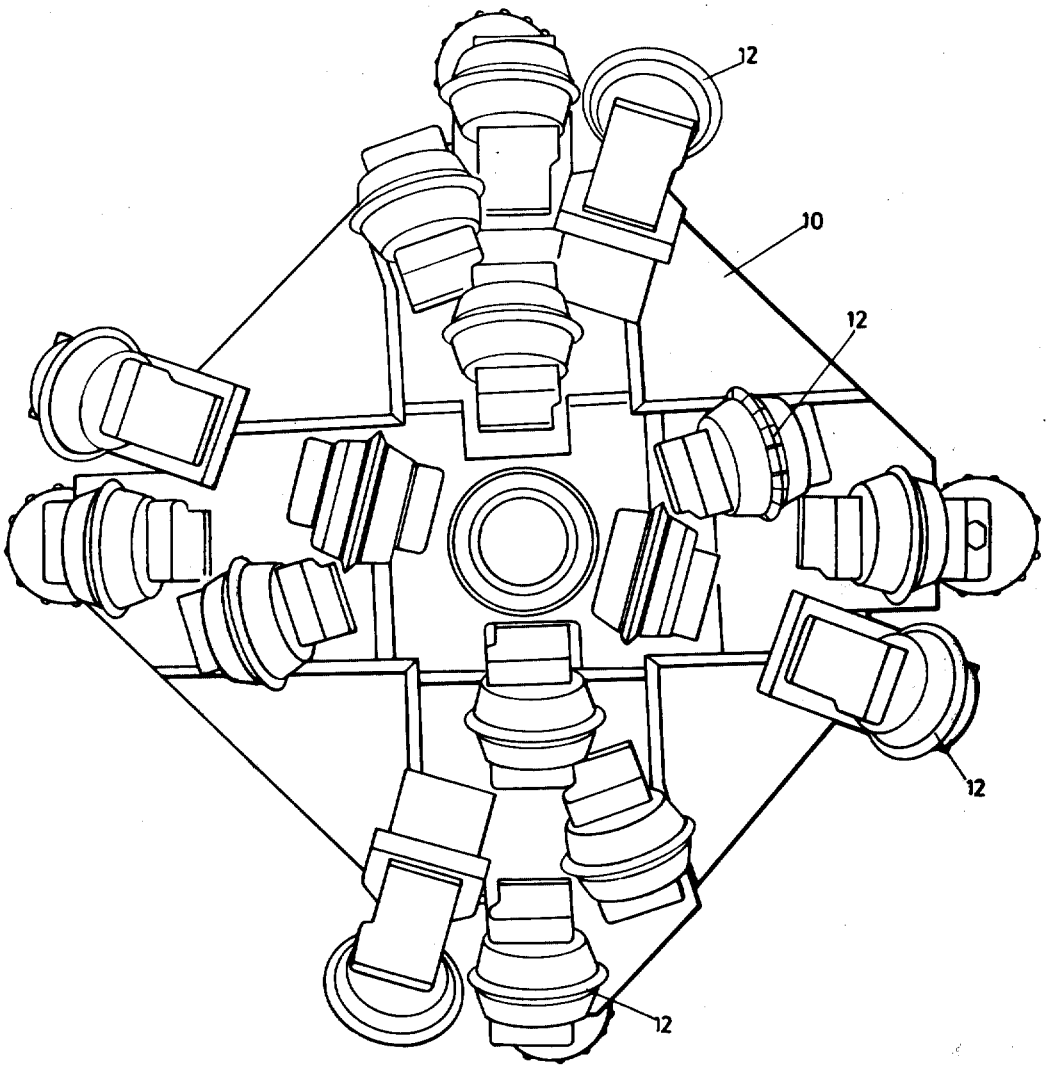
FIG. 4 shows a front view of the rotatable headplate on which the disc cutters are mounted.

With reference to FIG. 4 there is shown the front face of a rotatable headplate 10 known per se. A plurality of the disc cutters 12 of the invention are mounted on the front face. One of these disc cutters 12 is illustrated in FIGS. 1 and 2.

Figure 1:
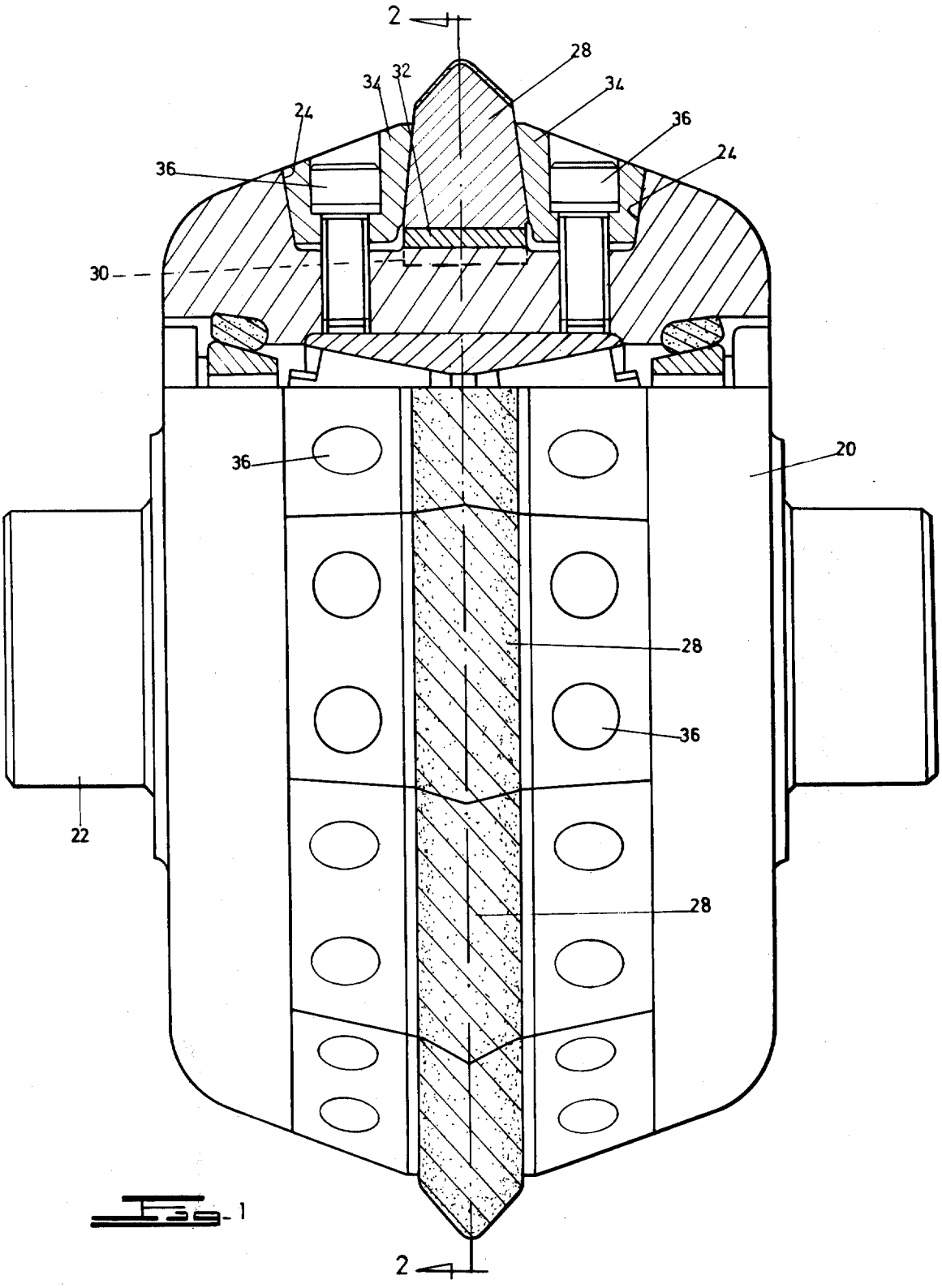
FIG. 1 shows a part sectional view of the disc cutter of the invention.
Figure 2:
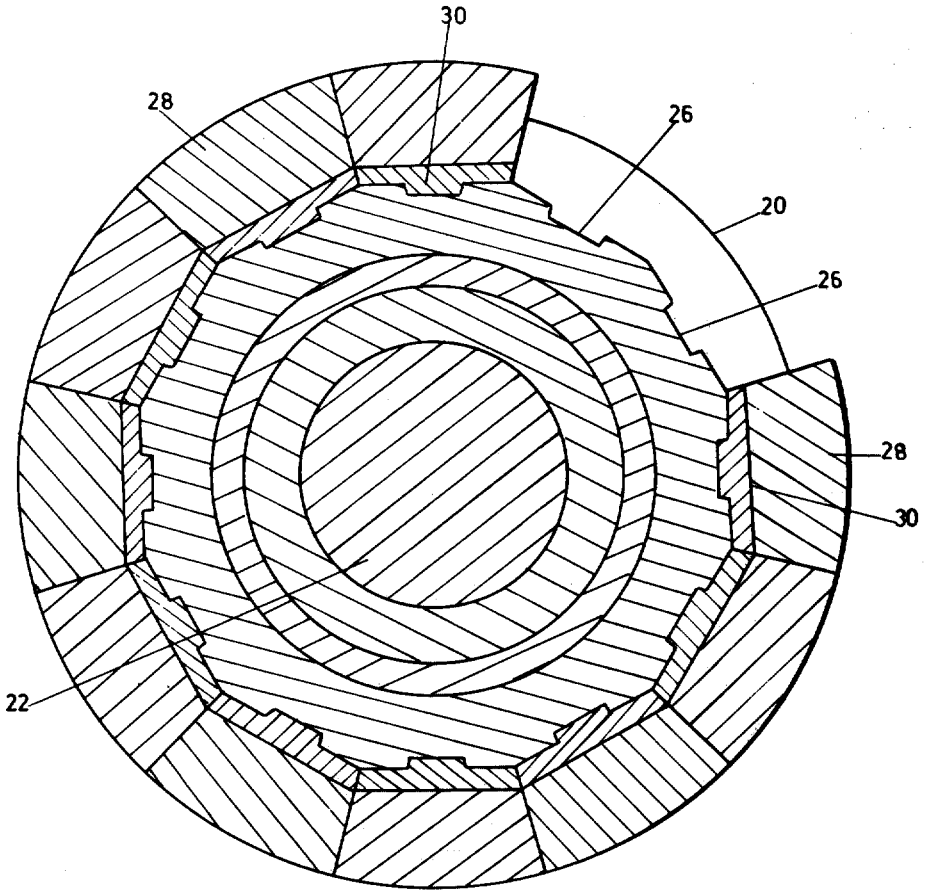
FIG. 2 shows a cross section of the disc cutter along the line 2—2 in FIG. 1 (with two cutting segments removed)

With reference to FIGS. 1 and 2 the disc cutter comprises an annular body 20 having a bearing shaft 22 adapted to be secured to a saddle on the front face of the headplate 10. The body 20 is journalled for rotation on the bearing shaft.

A continuous recess 24 extends around the periphery of the annular body 20, and on the base of this recess there is formed a plurality of spaced, transverse slots 26.

A plurality of cutting segments 28 made of tungsten carbide or other suitable material are located in and around the recess 24 to encircle the annular body 10.

Figure 3:
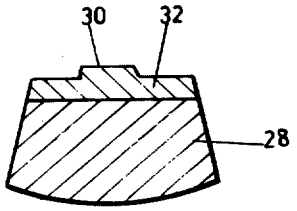
FIG. 3 shows one of the cutting segments of the invention.

The lower part of each of the cutting segments 28 is formed with a keying formation 30 (see FIGS. 2 and 3) which is adapted to engage with one of transverse slots 26 to prevent the cutting segment from moving around the recess 24 during use of the machine. The keying formation 30 on each cutting segment 28 is formed integrally with a base portion 32 made of steel which is brazed or otherwise secured to the cutting segment.

The cutting segments 28 are secured in position on the annular body 10 by means of clamping blocks 34 which bear against the sides of the cutting segments 28 in the recess 24. The clamping blocks are secured to the annular body by means of bolts 36.

Replacement of any of the cutting segments is effected merely by removing the clamping blocks associated with the faulty cutting segment and removing the faulty segment from the recess 24.

We claim:

1. A rock boring machine of the kind including a rotatable head plate, a plurality of rotatable disc cutters mounted on the front base of said rotatable head plate, each disc cutter comprising an annular body, a plurality of cutting segments located on and substantially encircling the annular body around the periphery thereof, and removable clamping means for securing the cutting segments to the annular body, each cutting segment comprising a key which is adapted to engage with a complementary slot in the annular body, said key being formed integrally with a base portion which in turn is suitably secured to the cutting segment.

2. A rock boring machine of the kind including a rotatable head plate, a plurality of rotatable disc cutters mounted on the front base of said rotatable head plate, each disc cutter comprising an annular body, a plurality of cutting segments located on and substantially encircling the annular body around the periphery thereof, a plurality of separate formations spaced about the periphery of the annular body, each cutting segment being provided with a complementary formation adapted to lockingly engage one of the formations on the body to prevent peripheral movement of the cutting segments around the body, and removable clamping means for securing the cutting segments to the annular body.

3. A rock boring machine as claimed in claim 2 in which the formations spaced around the periphery of the annular body are a plurality of slots, and the formations on the cutting segments are keys.

4. A rock boring machine as claimed in claim 3 in which the key on each cutting segment is formed integrally with a base portion which, in turn, is suitably secured to the cutting segment.

* * * * *